United States Patent [19]

Rutherford

[11] 4,105,168

[45] Aug. 8, 1978

[54] ROLLED PAPER HOLDER

[76] Inventor: Bernard R. Rutherford, 447 Moorehaven Dr., Carson, Calif. 90744

[21] Appl. No.: 747,236

[22] Filed: Dec. 3, 1976

[51] Int. Cl.[2] ..... A47K 10/16

[52] U.S. Cl. ..... 242/55.2

[58] Field of Search ..... 242/55.2, 55.3, 55.53; 211/123, 7, 16; 248/216; D6/99, 97

[56] References Cited

U.S. PATENT DOCUMENTS

| | | | |
|---|---|---|---|
| 2,021,417 | 11/1935 | Hoffman | 242/55.2 |
| 2,905,404 | 9/1959 | Simmons | 242/55.2 |
| 3,088,686 | 5/1963 | Curry | 242/55.2 |
| 3,596,861 | 8/1971 | Baldini | D6/103 |

FOREIGN PATENT DOCUMENTS

| | | | |
|---|---|---|---|
| 1,301,030 | 8/1969 | Fed. Rep. of Germany | 242/55.2 |

*Primary Examiner*—George F. Mautz

*Attorney, Agent, or Firm*—Jack C. Munro

[57] ABSTRACT

A holder for rolls of paper, such as toilet paper and paper towels comprising a pair of members interconnected together with one member being slideably movable with respect to the other member. The members are interconnected through a coil spring which exerts a continuous bias upon the members tending to maintain the members in the operative position rotatably supporting the roll of paper. A bracket assembly is connectable to the members to facilitate mounting of such to a planar supporting surface, such as a wall or cabinet.

2 Claims, 11 Drawing Figures

ROLLED PAPER HOLDER

BACKGROUND OF THE INVENTION

The field of this invention relates to a holding device to facilitate dispensing of material, and more particularly to a device which will support a roll of paper to facilitate dispensing and usage of the paper.

A common method of packaging paper is in the form of a roll. Such rolls have some form of supporting core in the shape of a cylinder and the paper is wound upon this core. The core is hollow and a rod can therefore be placed within the core and the resulting roll of paper to be dispensed by being manually turned upon the rod. Common household types of paper which are manufactured in this manner are paper towels and toilet tissue.

Previously, there have been designed roll paper holders, such roll paper holders being numerous and of all types of construction. Most such holders, in the past, have been complicated in construction and therefore expensive to manufacture. Additionally, such holders of the prior art have been difficult to operate and, in particular, did not readily facilitate removal of the core of a spent roll and reinsertion of a new roll of paper upon the holder. It is believed that the device of the present invention overcomes the aforementioned problems.

SUMMARY OF THE INVENTION

The holder of this invention comprises a pair of members, with one member being fixedly secured to a supporting surface. The other member is slideably mounted in a non-pivoting manner with respect to the first member. Movement of the second member with respect to the first member is limited between a roll paper supporting position and an extended position facilitating removal of the spent core of the roll of paper and insertion of a new supply of rolled paper. Spring biasing means interconnects the second member and the first member and exerts a continuous bias tending to maintain the members in the paper roll supporting position. The portions of the members which physically and directly support the roll of paper include an exterior roughened surface to act as a frictional drag against the paper roll rotating inertially. Stop means is incorporated between the members to limit the movement in the extended position. In attaching the device to the supporting surface, a recess means is incorporated around the screw fasteners which are to be inserted within the supporting surface. This recess means is to provide space for the displaced material of the supporting surface to enter and therefore permitting the holder to be placed flush against the supporting surface.

DETAILED DESCRIPTION OF THE SHOWN EMBODIMENTS

Referring particularly to the drawings, there is shown within FIGS. 1 through 7, the first embodiment of holder 20 of this invention. The holder 20 has been designed preferably to support a roll of paper 22, such roll of paper usually taking the form of toilet tissue. However, it is considered to be within the scope of this invention that the first embodiment 20 could be employed to support other types of rolls of paper than toilet tissue.

Figure 1:
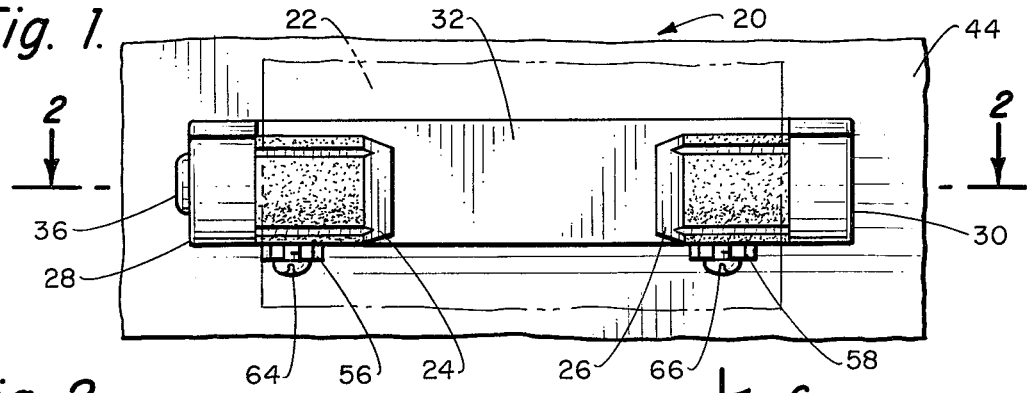
FIG. 1 is a front view of the first embodiment of the rolled paper holder of this invention.

The paper roll 22 is to include a hollow core (not shown) and within this hollow core is to be loosely fitted a first cylindrical shaped member 24 and a second cylindrical shaped member 26. The members 24 and 26 will normally be constructed of a rigid material, such as plastic. The exterior surface of the members 24 and 26 is to be roughened as is shown in FIG. 1 of the drawings. The members 24 and 26 will normally be hollow in construction but this serves no useful purpose except for minimizing usage of the material of construction and thereby lowering manufacturing costs.

Figure 2:
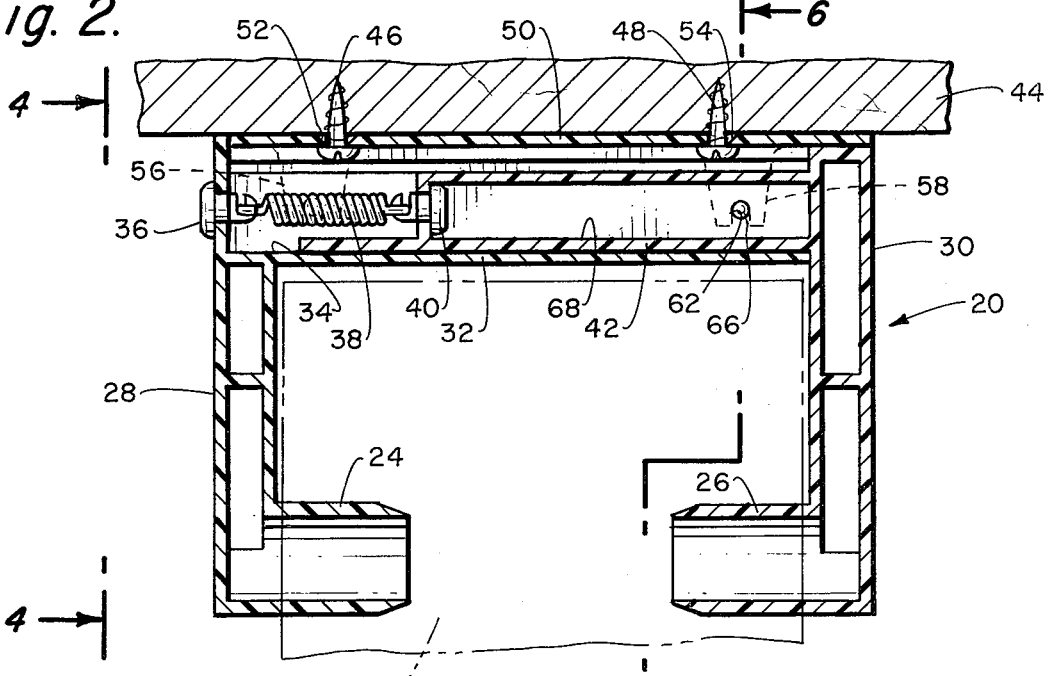
FIG. 2 is a cross-sectional view taken along line 2—2 of FIG. 1.
Figure 3:
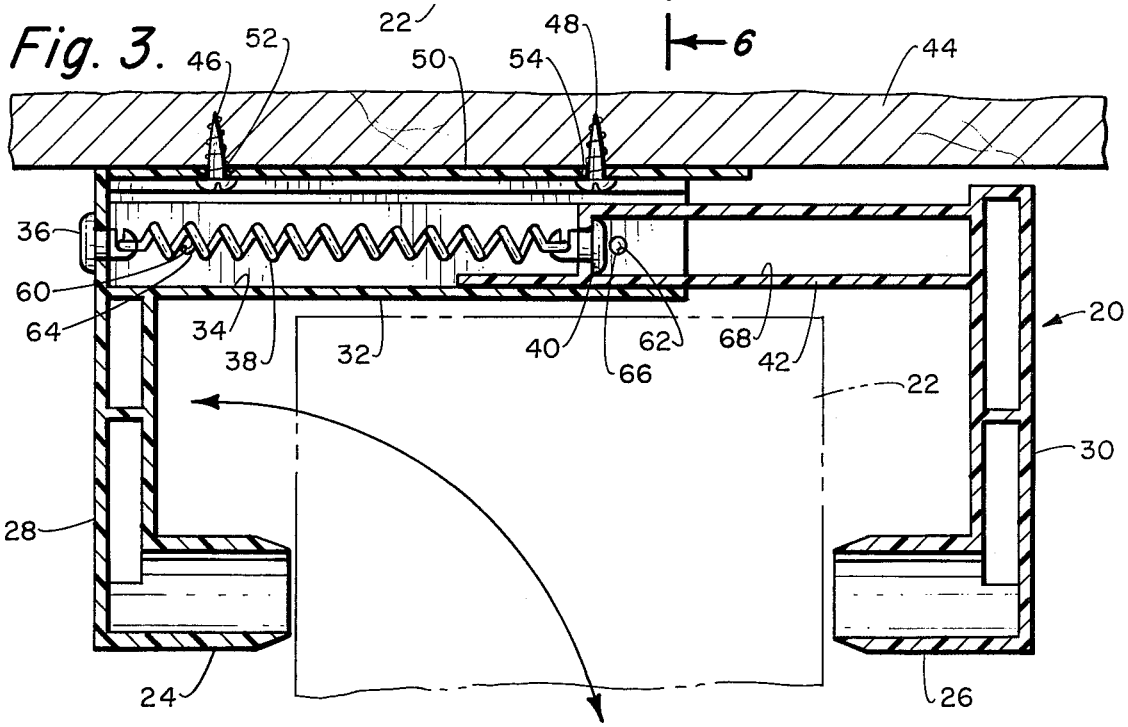
FIG. 3 is a view similar to FIG. 2, but showing the device in the extended position.
Figure 5:
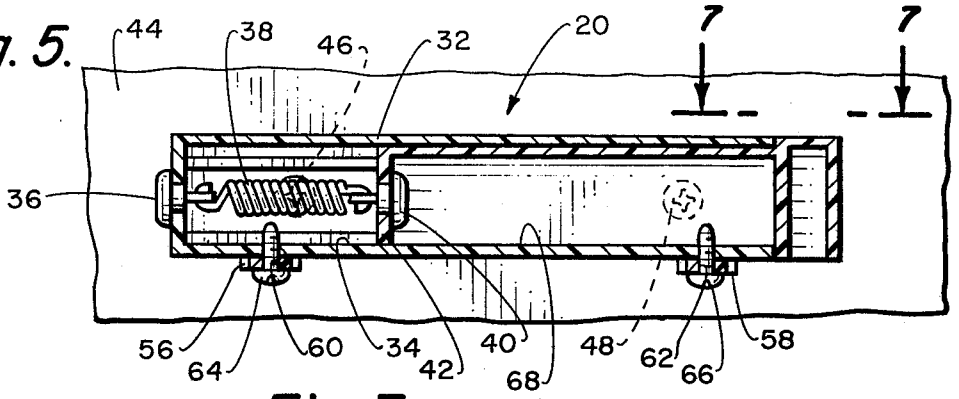
FIG. 5 is a cross-sectional view taken along line 5—5 of FIG. 4.
Figure 7:
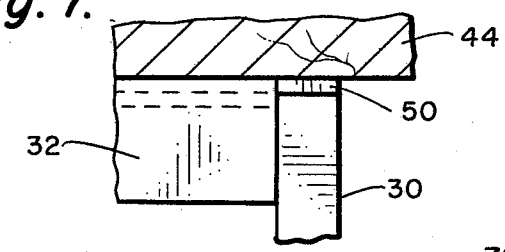
FIG. 7 is a portion of the first embodiment of the rolled paper holder of this invention taken along line 7—7 of FIG. 5.
Figure 4:
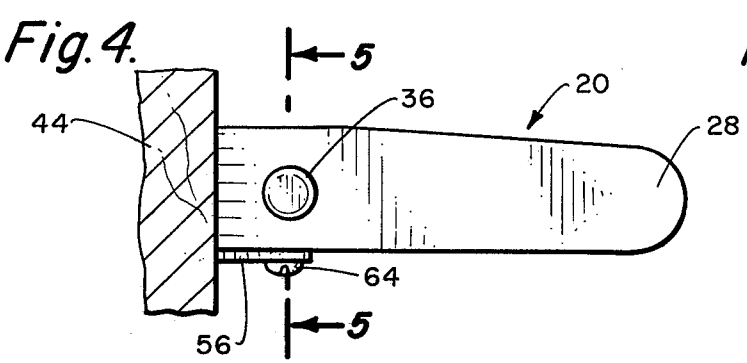
FIG. 4 is an end view of the first embodiment of the rolled paper holder of this invention taken along line 4—4 of FIG. 2.
Figure 6:
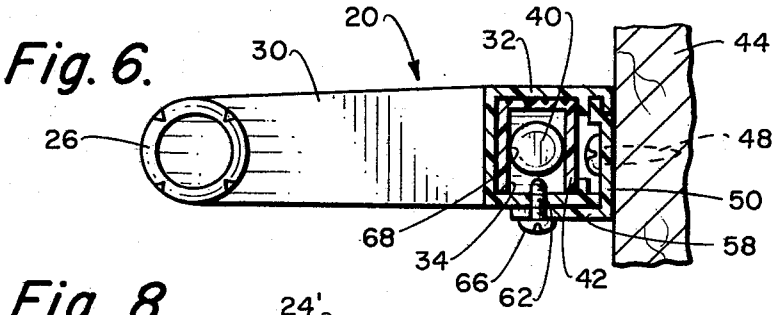
FIG. 6 is a partly in cross-section view of the first embodiment of the rolled paper holder of this invention taken along line 6—6 of FIG. 2.
Figure 8:
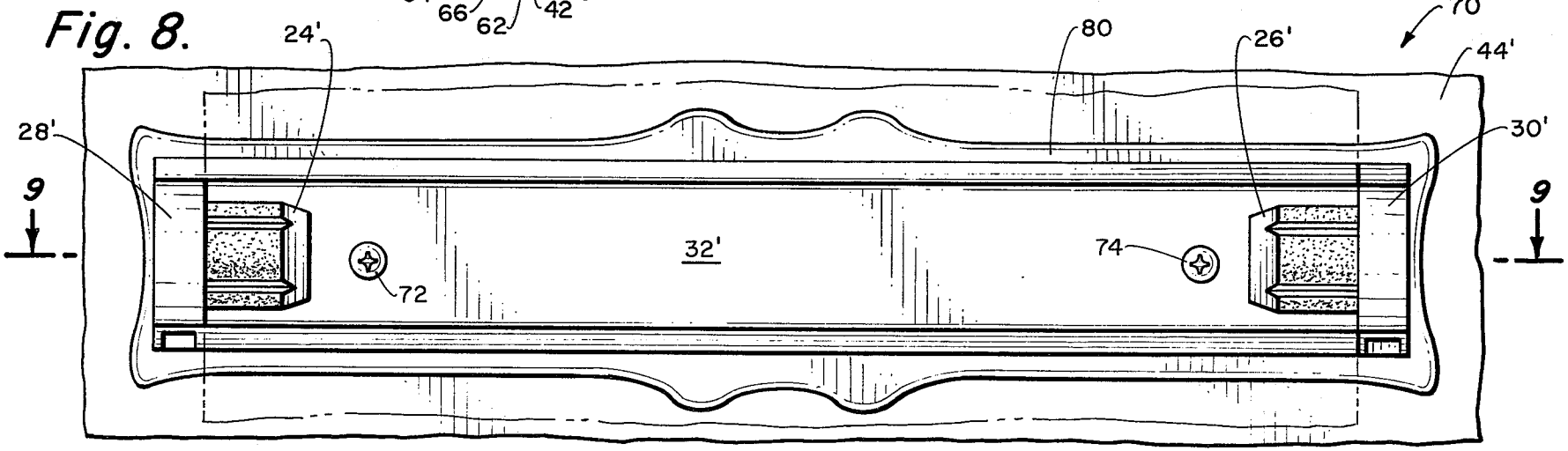
FIG. 8 is a front view of a second embodiment of the paper holder of this invention.
Figure 9:
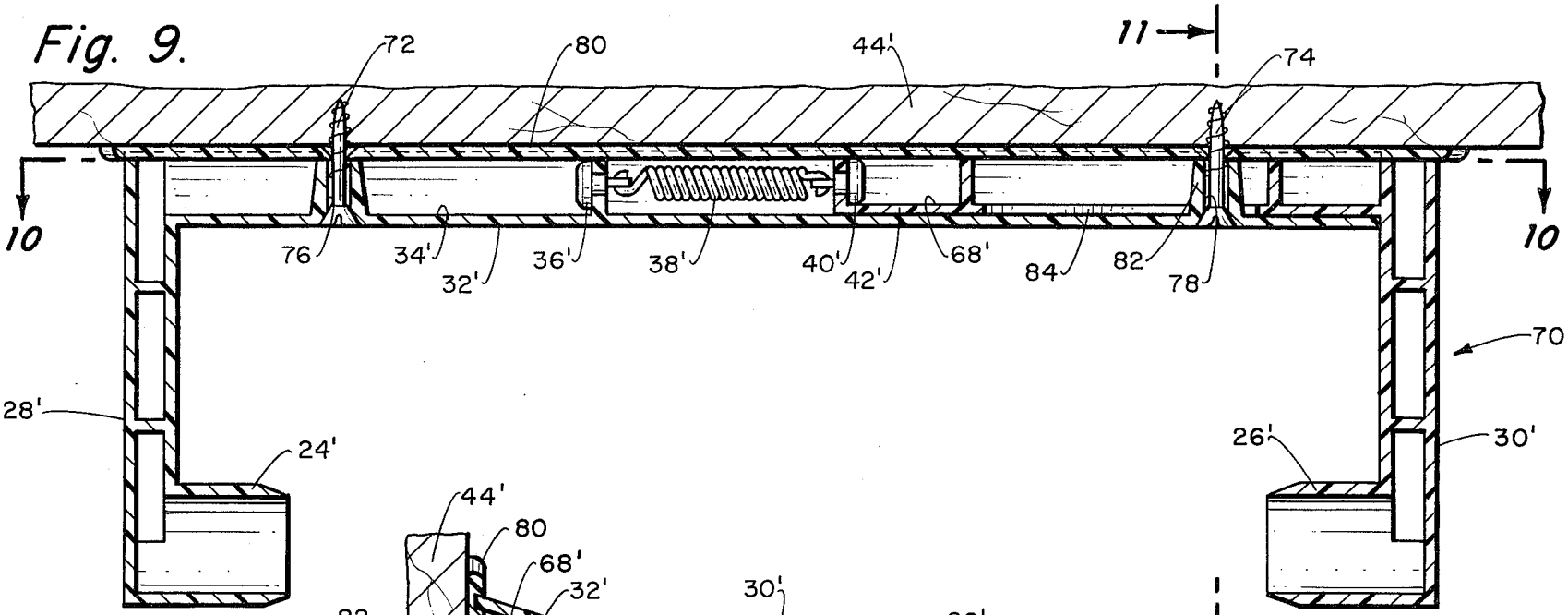
FIG. 9 is a cross-sectional view taken along line 9—9 of FIG. 8.
Figure 11:
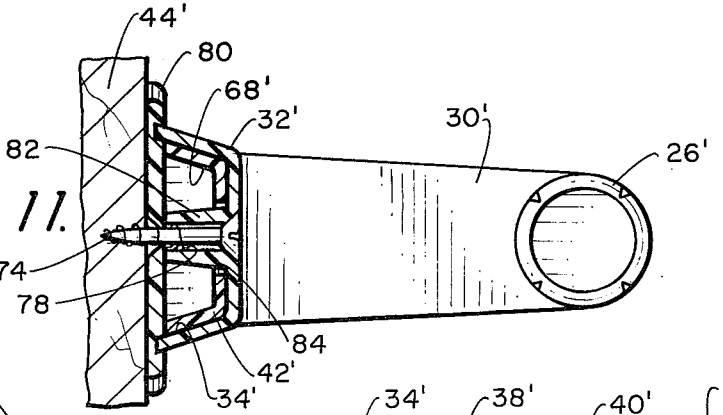
FIG. 11 is a cross-sectional view taken along line 11—11 of FIG. 9.
Figure 10:
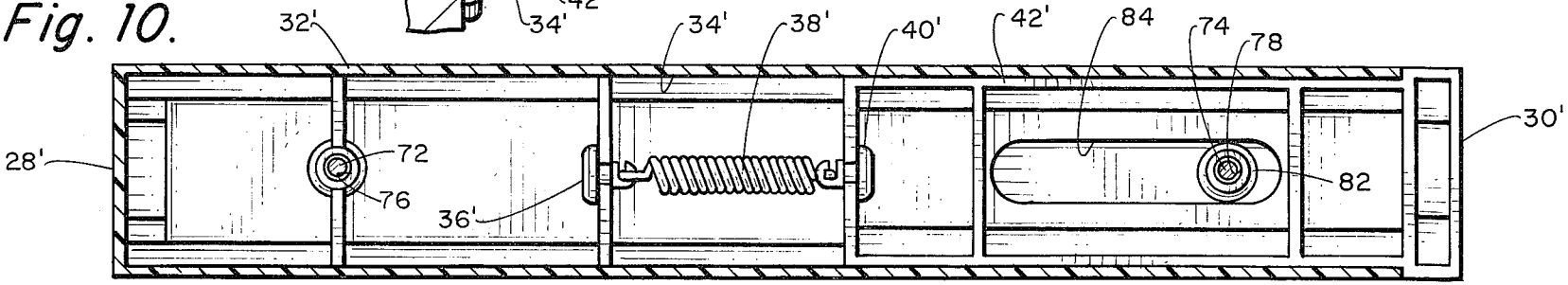
FIG. 10 is a cross-sectional view taken along line 10—10 of FIG. 9.

Member 24 is integrally connected to a first arm 28. Member 26 is integrally connected to a second arm 30. Arm 28 is integrally connected to a fixable member 32. The member 32 includes a hollow interior chamber 34. Extending through the closed end wall of the member 32 and to within the chamber 34 is a first pin 36. The pin 36 connects with one end of coil spring 38. The other end of the coil spring 38 connects to a second pin 40. The pin 40 is fixedly mounted within movable member 42. Member 42 is telescopingly received within the chamber 34 and slideable between an inner or first position and an extended or second position. The first position is shown in FIGS. 1 and 2 of the drawings and in this position is adapted to support the roll of paper 22. The extended position is shown in FIG. 3 of the drawings and in this position the roll of paper 22 may be removed and replaced. A movable member 42 is integrally connected to the second arm 30.

Attached to the supporting surface 44 by means of screw fasteners 46 and 48 is a plate 50. Within the surface of the plate 50 which abuts the supporting surface 44 in the area directly surrounding each of the fasteners 46 and 48 are annular recesses 52 and 54, respectively. When the fastener 46 enters the supportive surface 44, the displaced material of the supportive surface 44 has a tendency to formed a raised protuberance. This material upon entering fastener 46 is then permitted to enter within the recess 52. In a similar manner, the material displaced by fastener 48 enters the recess 54. This permits the plate 50 to rest flush against the supportive surface 44.

Integrally attached to the lower edge of the plate 50 is a first attaching bracket 56. Also integrally attached to the lower edge of the plate 50 and spaced from the bracket 56 is a second attaching bracket 58. Within the bracket 56 is located an open ended slot and a similar such slot is formed within the bracket 58. The fixed member 32 is to rest upon the upper surface of the brackets 56 and 58. Formed within the lower surface of the member 32 are a pair of spaced apart openings 60 and 62. The spacing between the openings 60 and 62 is identical to the spacing between the open ended slots of the brackets 56 and 58. A screw fastener 64 is to cooperate with the open ended slot located within the bracket 56 and tightly cooperate within the opening 60. A similar fastener 66 is to cooperate with the open ended slot formed within bracket 58 and tightly extend within the opening 62. As a result, the member 32 is fixedly secured with respect to the plate 50 which, in turn, is fixedly secured to the supportive surface 44. The member 26, its connected arm 30 and the movable member 42 is the only portion of the holder 20 which is capable of movement. Because the fastener 66 extends to within chamber 68 of the movable member 42 and upon the member 42 being completely moved to the extended position, this screw fastener 66 will come into contact with the pin 40 and therefore functions as a stop limiting the movement to the extended position.

Referring particularly to the second embodiment 70 of the holder of this invention which is shown in FIGS. 8 through 11, like numerals have been employed to refer to parts which are identical with the first embodiment 20. To differentiate the numerals within the second embodiment 70, the numerals will only be altered in the manner of including a "prime". A detailed discussion of these particular members is believed to not be necessary and reference is to be had to the previous description.

The primary difference between the second embodiment 70 and the first embodiment 20 is directed to the method of attaching to the supporting surface 44'. The member 42' is still slideably movable within the chamber 34' of the member 32', however, the securing to the supportive surface 44' is by means of elongated screw fasteners 72 and 74 which extend respectively through appropriate openings 76 and 78 formed directly through the front of the fixable members 32'. The back end (which is open) of the member 32' is to be in abutting contact with a plate 80 which, in turn, rests flush against the supporting surface 44'. The opening 78, which is located within sleeve 82, cooperates within an elongated slot 84 formed within the movable member 42'. The length of the slot 84 limits the amount of movement of the movable member 42' between the retracted position shown in FIGS. 9 and 10 of the drawings and the extended position (not shown). In the extended position, the inner end of the slot 84 will come into physical contact with the sleeve 82. The spring 38'' still functions to exert a continuous bias upon the movable member 42' tending to maintain such in the retracted position. The back end of the fixed member 32', itself comprising a thin peripheral edge, fits within a corresponding mating group formed within the plate 80. It is also to be understood that the cylindrical members 24' and 26' include roughened surfaces as shown in the first embodiment.

What is claimed is:

1. A rolled paper holder comprising:

a first member assembly adapted to rotatably support one end of a roll of paper;

a second member assembly adapted to rotatably support the other end of a roll of paper;

said first member assembly including a first mounting section, said second member assembly including a second mounting section, said second mounting section being received within said first mounting section and being slidable in respect thereto between a first position and a second position, said first position being capable of rotatably supporting a roll of paper, said second position adapted to permit disassociation and insertion of a roll of paper;

biasing means interconnecting said first mounting section and said second mounting section, said biasing means exerting a continuous bias between said mounting sections tending to maintain said second mounting section in said first position;

separate wall mounting bracket assembly to facilitate attachment to both said first member assembly and said second member assembly to fixedly mount said member assemblies upon a vertical supporting surface;

a screw fastener assembly securing said mounting bracket assembly to the vertical supporting surface, said screw fastener assembly comprising at least one (in number) fastener extending through an opening in said mounting bracket assembly, recess means formed on the interior surface of said mounting bracket assembly connecting with said opening enlarging said opening on said interior surface side of said mounting bracket assembly, whereby upon entering of said fastener into the vertical supporting surface the displaced material from the vertical supporting surface is permitted to move within said recess means and thereby permit said bracket assembly to rest flush against the vertical supporting surface; and a second screw fastener assembly interconnecting said first and second member assemblies to said wall mounting bracket assembly, said second screw fastener assembly including a second screw fastener connecting together said second member assembly and said wall mounting bracket assembly, said second screw fastener functioning as a stop to limit the movement of said second member assembly with respect to said first member assembly.

2. A rolled paper holder comprising:

a first member assembly adapted to rotatably support one end of a roll of paper;

a second member assembly adapted to rotatably support the other end of a roll of paper;

said first member including a first mounting section, said second member assembly including a second mounting section, said second mounting section being received within said first mounting section and being slideable in respect thereto between a first position and a second position, said first position being capable of rotatably supporting a roll of paper, said second position adapted to permit disassociation and inserting of a roll of paper;

biasing means interconnecting said first mounting section and said second mounting section, said biasing means exerting a continuous bias between said mounting sections tending to maintain said second mounting section in said first position;

separate wall mounting bracket assembly to facilitate attachment to both said first member assembly and said second member assembly to fixedly mount said member assemblies upon a vertical supporting surface; and a screw fastener assembly interconnecting said first and second member assemblies to said wall mounting bracket assembly, said screw fastener assembly including a screw fastener connecting together said second member assembly and said wall mounting bracket assembly, said screw fastener functioning as a stop to limit the movement of said second member assembly with respect to said first member assembly.

* * * * *